United States Patent [19]

Salomon

[11] 4,135,733

[45] Jan. 23, 1979

[54] SAFETY BINDINGS FOR SKIS

[75] Inventor: Georges P. J. Salomon, Annecy, France

[73] Assignee: S.A. Salomon Etablissements Francois Salomon & Fils., Annecy, France

[21] Appl. No.: 804,148

[22] Filed: Jun. 6, 1977

[30] Foreign Application Priority Data

Jun. 18, 1976 [FR] France ..... 76 18513

[51] Int. Cl.[2] ..... A63C 9/08

[52] U.S. Cl. ..... 280/612

[58] Field of Search ..... 280/612, 611, 613

[56] References Cited

U.S. PATENT DOCUMENTS 3,892,980 7/1975 Anderson ..... 280/612

3,907,316 9/1975 Marker et al. ..... 280/612

3,919,563 11/1975 Lautier et al. ..... 280/612

*Primary Examiner*—Joseph F. Peters, Jr.

*Assistant Examiner*—Milton L. Smith

*Attorney, Agent, or Firm*—Haseltine, Lake & Waters

[57] ABSTRACT

A safety binding for skis in which release of the boot from the ski is effected by a signal issuing from an electrical circuit. The electrical signal is a function of the force applied to a skier's leg, and is received in a circuit which compares the signal with different successive threshold levels, which are functions of different duration of application of the force. The release mechanism of the binding is operated if the value of this signal reaches, in an interval of time corresponding to a determined threshold level, the value of this level.

8 Claims, 7 Drawing Figures

S
14
a b c d e f g h
17
18
15
19
21
22
abcdefgh
a'b'c'd'e'f'g'h'
23₄
23₃
23₂
23₁
24
6

SAFETY BINDINGS FOR SKIS

FIELD OF THE INVENTION

The present invention relates to a safety binding for skis, and more particularly to a binding in which the release of the skier's boot is effected by a signal issuing from an electrical circuit.

PRIOR ART

Bindings are known whose release is achieved mechanically against the action of one or more springs which are regulated in terms of the force starting from which the freeing of the boot is required. These bindings are not perfect because the release is only effected in terms of the intensity of the force and does not take into account the duration of application of the force. Now it is known that the leg bone of a skier can withstand a violent force provided it is brief. The value of the force sustainable by the leg of a skier decreases in terms of the time during which this force is applied. In other words, the greater the duration of the force, the lesser its value has to be in order to be bearable by a skier.

Ski bindings with release achieved by an electrical circuit to take account of the time factor, that is to say, the duration of the application of a force, are already known. Generally in these bindings an integrator circuit for integrating the force as a function of the time is used, and the value of this integration is compared with a threshold regulable in terms of the skier. The order for release of the binding is only given if the value of the integration exceeds the preset threshold.

In order to obtain a very precise order for release, this solution presumes that the variation of maximum force sustainable by the leg in terms of time is rigorously hyperbolic. It is, in fact, only in this case that the integration of the maximum force which is bearable in terms of the time has a constant value corresponding to the release threshold. In fact, the theoretical curve of the maximum force is not rigorously a hyperbola, and in consequence the utilization of the integration of the force as a function of time and the comparison of this integration with a constant predetermined threshold does not allow a perfect precision of the transmission of the release order to be obtained.

SUMMARY OF THE INVENTION

The present invention seeks to remedy this drawback by providing a binding in which the release order for the binding is given with certainty immediately when the intensity of the force applied to the leg of the skier exceeds a predetermined threshold in a given interval of time. To this effect this safety binding for skis provides at least one device for holding the boot on the ski, means for securing this device, means for releasing the securing means to allow the release of the holding device, and an electrical control circuit for the releasing means comprising means for detecting a force on the leg of a skier and producing an electrical signal, which is a function of this force, and means for treating this signal to control the operation of the releasing means in terms of the intensity of said force and its duration, the means for treating the signal comprising means for comparing the signal representing the detected force with successive different threshold levels of values which are a function of the duration of these forces and to control the releasing means if the value of this signal reaches, in the interval of time corresponding to a determined threshold level, the value of this threshold. According to a preferred feature, the successive threshold levels are of decreasing values in terms of the duration of the forces.

In choosing judiciously the value of the individual threshold levels constituting so many elementary thresholds and the intervals of time during which these elementary thresholds must be taken into consideration for the operation of the releasing means, it is possible to obtain a response curve for the binding having a stepped nature which matches at best the real curve giving the variation of the maximum force sustainable by the leg in terms of time, whatever the real trend of this curve. Thus, from this fact, a very high precision is obtained in transmitting the release orders for the binding, this transmission taking into account, at the same time, the intensity of the forces and the duration of their application. The binding according to the invention additionally provides the feature of not introducing phase displacement for the control of the release.

BRIEF DESCRIPTION OF THE DRAWINGS

An embodiment of the present invention will now be described, by way of example, with reference to the accompanying drawings in which.

DETAILED DESCRIPTION

Figure 1:
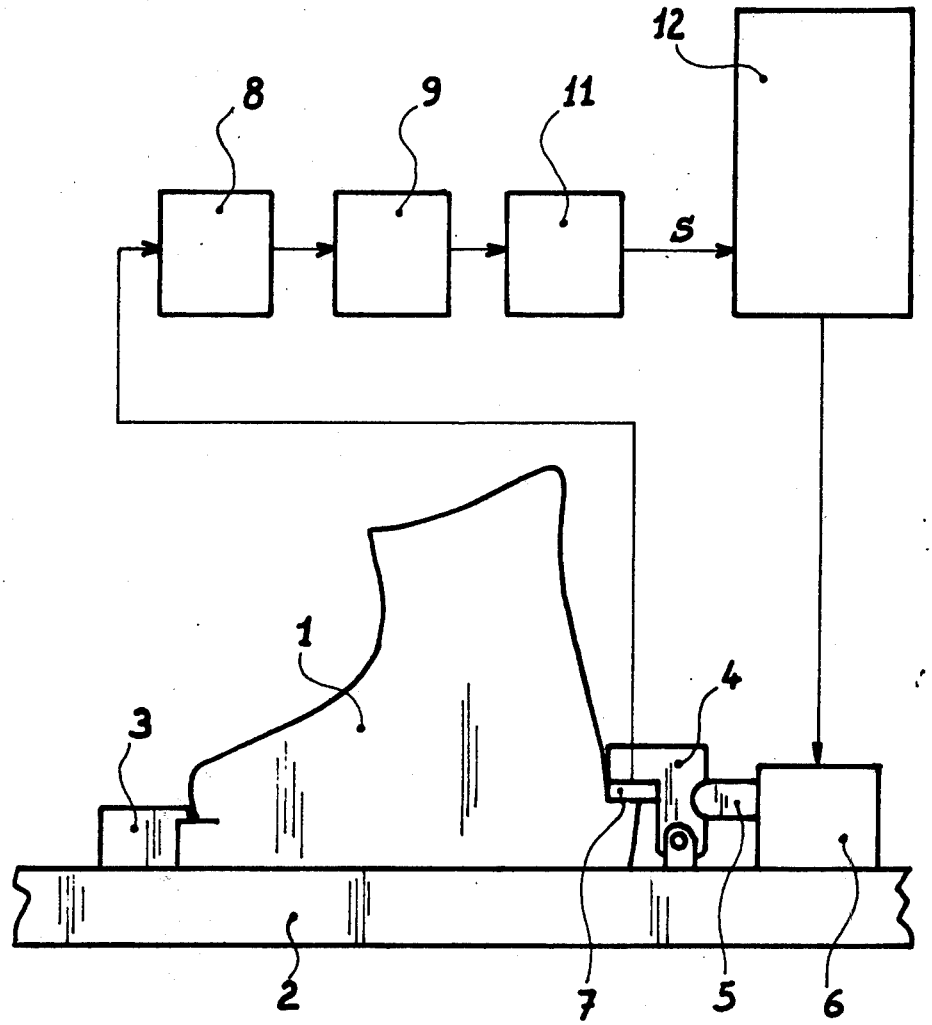
FIG. 1 diagrammatically illustrates a safety binding for a ski accrding to the invention, with the control circuit shown in block diagram, the electrical supply not being shown.

In FIG. 1, there is shown a boot 1 held on a ski 2 by a safety binding with front and rear holding means 3 and 4 respectively. The rear holding means 4 is pivotal and it is kept locked during skiing, by a latching device 5. An unfastening or release device 6 co-operates with the latching device 5 to ensure the locking of the holding means 4, in normal usage conditions of the ski, and also to ensure unlocking of the means 4 when the binding must be released, for example, after a fall.

The safety binding according to the invention also comprises an electrical control circuit for its release. This circuit comprises means for detecting the forces exerted on the leg of the skier. Such detecting means are constituted by one or more pick-ups placed at the front, at the back, or under the boot to detect all the forces applied to the latter. In FIG. 1, the binding includes a pick-up 7 placed on the heel of the boot.

The electrical control circuit also includes an amplifier 8 to which is connected the pick-up 7. Thus, electrical signals from the pick-up 7 which are a function of the forces acting on the leg of the skier, are amplified by the amplifier 8 which is of the integrated circuit type. This amplifier preferably has a controllable gain to allow for a method of control as described later.

The output signal of the amplifier 8 is rectified in a rectifier 9 and is transmitted to a non-linear amplifier 11. In this way, the input signals to the non-linear amplifier 11 are amplified with a gain which is a function of their amplitude. In fact, this gain is an increasing function of the amplitude of the input signal so that input signals of weak amplitude to the amplifier 11 are less amplified than the input signals of strong amplitude. The reason for this variation in gain will be explained later with reference to FIGS. 2 and 3.

The non-linear amplifier 11 is advantageously composed of an operational amplifier and a network of diodes.

The output signal S of the amplifier 11 whose amplitude is a function of the intensity of force and its corresponding duration, is applied to a treatment circuit 12 which defines a threshold constituted by different successive levels in terms of time and the output of which is connected to the unfastening device 6. The circuit 12 for treating the signal is conceived in such a manner that it transmits a signal to the unfastening device 6 if the value of the signal, as a function of force, at the output of amplifier 11 is greater than one of the stepped threshold levels determined by the circuit 12.

Figure 2:
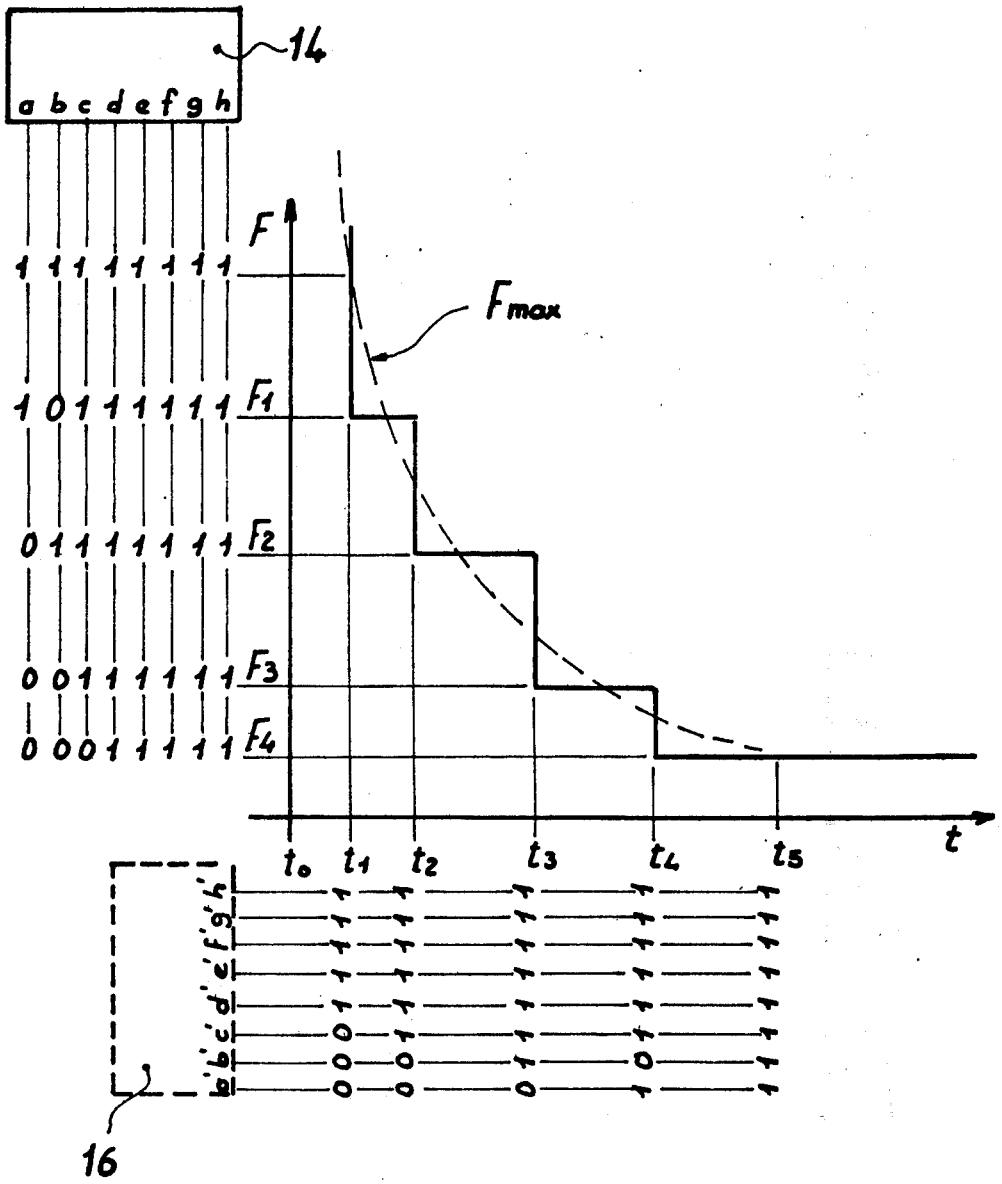
FIG. 2 is a graph representing an example of a stepped response curve of the binding.

A particular circuit for treating signal S and its method of operation will now be described with particular reference to FIGS. 2 and 3. In FIG. 2 is shown, in bold outline, a stepped curve determining the threshold to which is compared the signal which is a function of force. In this graph, the intensity F of the force is indicated on the ordinate, while time is indicated on the abscissa.

In the graph in FIG. 2 is also shown a theoretical curve giving the variation of the maximum force which the leg of the skier can bear in terms of time. This curve has a hyperbolic trend and it will be seen later, that the leg of a skier can sustain a greater force the shorter the time of application.

In the safety binding according to the invention, one can compare, in fact, the force to a succession of levels of different values F1, F2, F3, F4 diminishing in terms of the duration of the force. Only four levels have been shown in the graph of FIG. 2, but it is evident that one can forecast from this a greater number so that the stepped threshold curve conforms very closely to the theoretical curve $F._{max}$. The greater the number of levels, the closer the stepped threshold curve will correspond with the theoretical curve $F._{max}$.

The successive levels F1, F2, F3, F4 constitute elementary thresholds which are taken into consideration during the successive intervals of time t1–t2, t2–t3, t3–t4, t4–t5.

In order to achieve the stepped threshold thus defined and the comparison of the signal which is a function of force with this threshold, various means can be envisaged. FIG. 3 shows a block diagram of a combination of particularly simple circuits allowing this result to be obtained.

Figure 3:
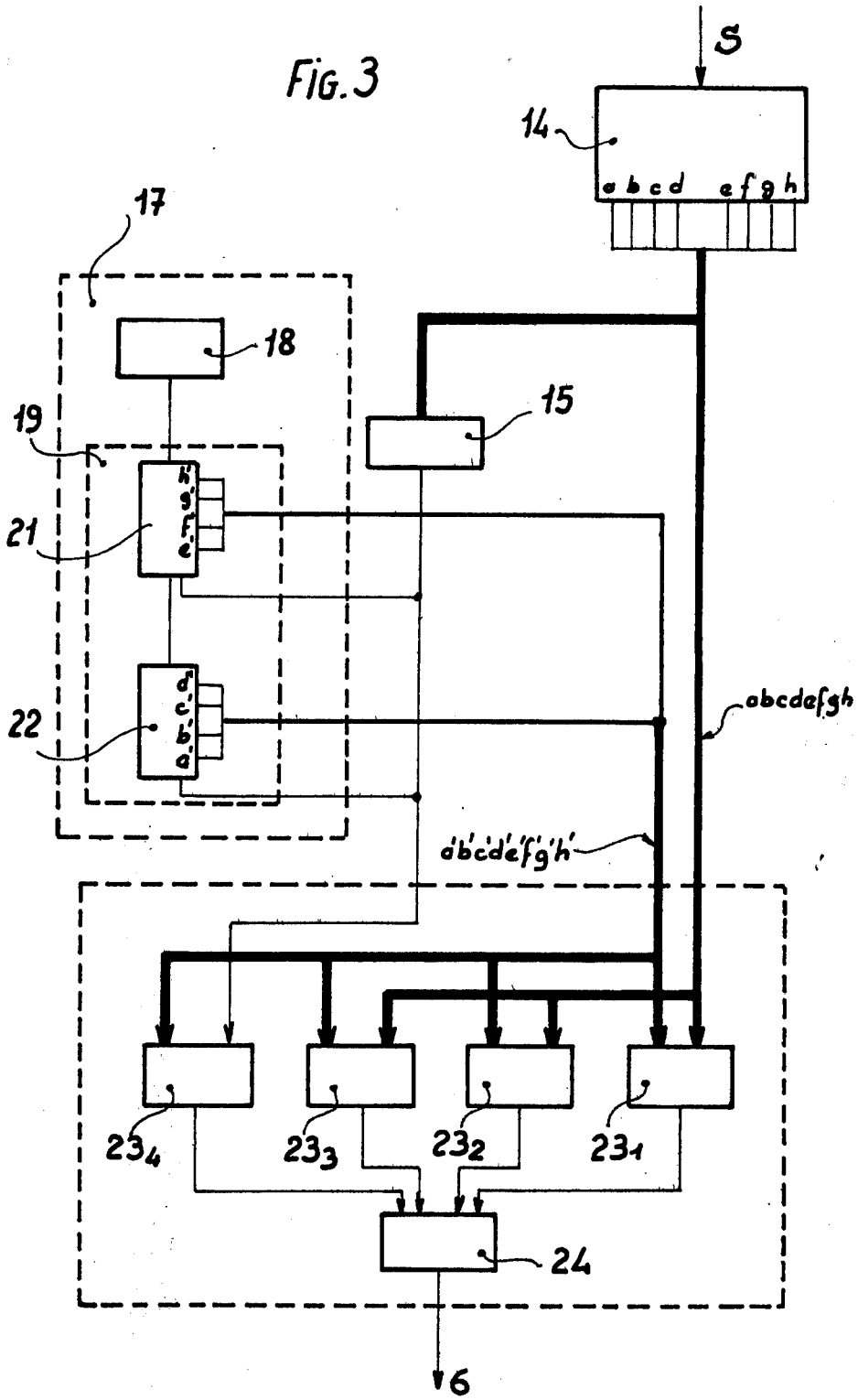
FIG. 3 is a block diagram of a circuit of the treatment of the signal as a function of force, the supply not being shown.

The circuit of FIG. 3 comprises an analog/digital converter 14 to which is transmitted the output signal S of the amplifier 11 which is a function of the detected force. The analog/digital converter 14 is of the integrated circuit type and as it is well known to those skilled in the art it will not be described in detail. For preference a converter 14 with eight outputs a, b, c, d, e, f, g, h, is used. Thus, each analog input signal S is transformed by the converter 14 into a combination of 8 bits in parallel. The parallel binary digital output signal from the converter 14 is introduced, on the one hand, into a reference circuit 15 and, on the other hand, into a logic unit 16. The reference circuit 15 is connected, in turn, to a unit 17 for counting time and to the logic unit 16.

The unit 17 comprises a frequency generator or clock 18, connected to a counter 19 constituted by two counting stages 21 and 22 in tandem. Each counting stage is a counter of base four and has four outputs. Thus, stage 21 has the outputs e', f', g', h', and stage 22 the outputs a', b', c', d'. The counting stages 21 and 22 are connected to the output of reference circuit 15, which controls their starting and their return to their original state as will be seen further on. Reference circuit 15 comprises one or more logic gates which detect the presence of a particular combination of bits corresponding to a reference threshold.

The logic unit 16 comprises as many logic cells with several inputs as there are levels in the stepped threshold shown in FIG. 2. As, in the example described, a threshold with four levels is under consideration, the logic unit 16 comprises 4 cells associated respectively with the various levels, namely cells $23_1$, $23_2$, $23_3$, and $23_4$.

These cells receive, at certain of their inputs combinations of bits transmitted from the analog/digital converter 14 corresponding to the amplitude of the force. They receive also, at other inputs, combinations of bits issuing from the counting unit 17 and defining intervals of time.

The outputs of the various cells $23_1$, $23_2$, $23_3$, $23_4$, are all connected together to an OR circuit 24, the output of which is connected to the unfastening device 6.

The operation of the circuit will now be described.

Each time that the leg of the skier is subjected to a force, the pick-up 7 emits a signal which, after having been amplified by the amplifier 11 appears in the form of the signal S of variable amplitude and duration as a function of the force. This signal is applied to the analog/digital converter 14 whose output is a combination of 8 bits defining at each instant the amplitude of the analog signal S. This combination of 8 bits a, b, c, d, e, f, g, h, thus varies instantaneously with the amplitude of the signal S.

This combination of bits is applied permanently, on the one hand, to the reference circuit 15 and, on the other hand, to the logic unit 16. The reference circuit 15, comprising one or more logic gates, determines the lower threshold limit from which the value of a force is taken into consideration. Expressed in another way, as long as the force applied to the leg of the skier is less than this threshold level, the circuit is not operational because the counting of time does not take place and the binding cannot release. By way of example, the lower threshold corresponding to the force $F_4$ in FIG. 2 is determined by the binary combination 00011111. As long as the amplitude of the force is less than the reference threshold $F_4$, the cells of the logic unit 16 do not operate because they do not receive information from the counting unit 17.

Let us suppose that at a given moment the force applied to the leg of the skier exceeds the value of the reference threshold $F_4$: this expresses itself by the appearance at the output of the converter 14 of a particular combination of bits which is detected by the reference circuit 15 as being higher than the binary value 00011111. At this instant the reference circuit 15 transmits an output signal which starts the counting stages 21 and 22. These then totalize the impulses emitted by the clock 18 and they produce as an output a combination of 8 bits 8 , b', c', d', e', f', g', h', which measure the time which has elapsed since the instant when the force reached the value of the reference threshold F. In the graph in FIG. 2 there are indicated along the abscissa, various combinations of bits emitted by the counting unit 17 and which define the instants t0, t1, t2, t3, t4 starting from the instant t0 where the reference circuit 15 detects the appearance of a combination of bits greater than the combination 00011111. In the same way there is indicated in the graph in FIG. 2 along the ordinate, various combinations of binary signals corresponding to the threshold levels F1, F2, F3 and F4.

The first interval of time t0, t1 is very small, and it is considered that in this interval all the forces are acceptable. Thus no threshold level has been forecast for this interval. If the force persists beyond the instant t1, it must not exceed level F1.

Figure 4:
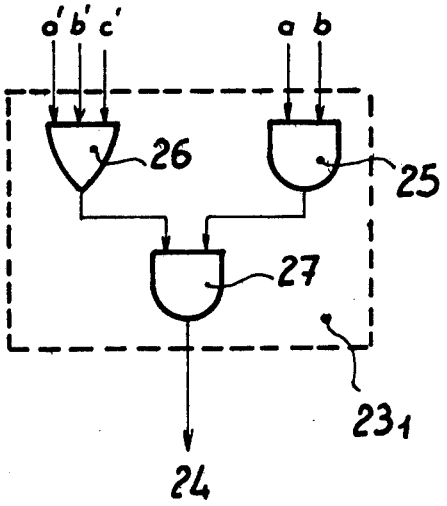
FIGS. 4, 5, 6 and 7 are diagrams of logic units used in the circuit of FIG. 3 for obtaining the curve represented in FIG. 2.

If this level is exceeded, the logic unit 16 transmits an order to the unfastening device. This is effected by means of the logic cell $23_1$ shown in FIG. 4. The logic cell $23_1$ comprises an AND gate 25 to the two inputs of which are applied bits a and b from the transformer 14 and an OR gate 26 receiving on its three inputs bits a', b', and c' from the counting stage 22. The outputs of these two gates are attached to an AND gate with two inputs 27 the output of which is connected to the OR circuit 24. It can be seen from FIG. 2 that for all the intervals of time exceeding the instant t1 one of the bits a', b', c', has the value 1. In consequence, the OR gate 26 outputs a level 1 signal to an input of the AND gate 27. For times longer than t1 the force should not exceed the magnitude of F1, otherwise the binding should release.

The binary value corresponding to the level F1 is 1,0,1,1,1,1,1,1. If the force is greater than level F1, the binary value is 1,1,1,1,1,1,1,1. The necessary and sufficient condition for the force to be greater than level F1 is thus a = 1 and b = 1. The AND gate 25 detects this coincidence and transmits a signal to the other input of the AND gate 27. The two inputs of the AND gate 27 being at level 1, this latter emits a signal which, transmitted by the OR circuit 24, is applied to the unfastening device 6 and releases the binding.

Figure 5:
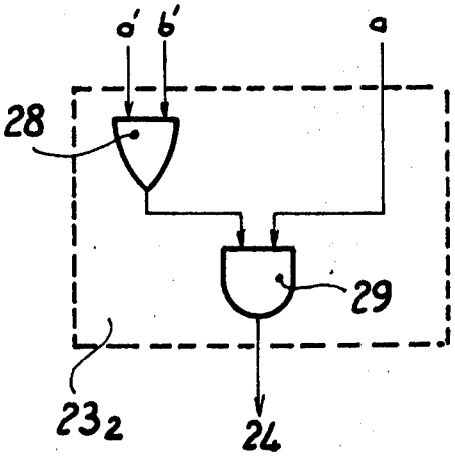
Figure 6:
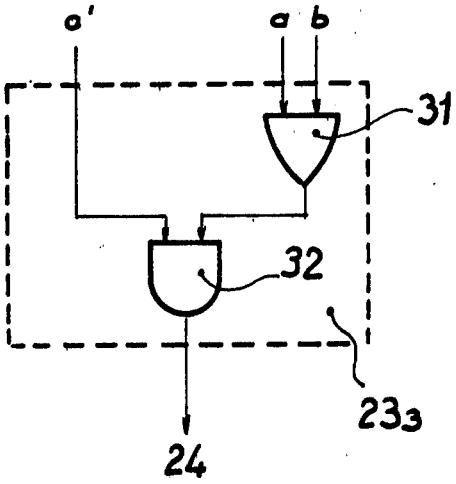
Figure 7:
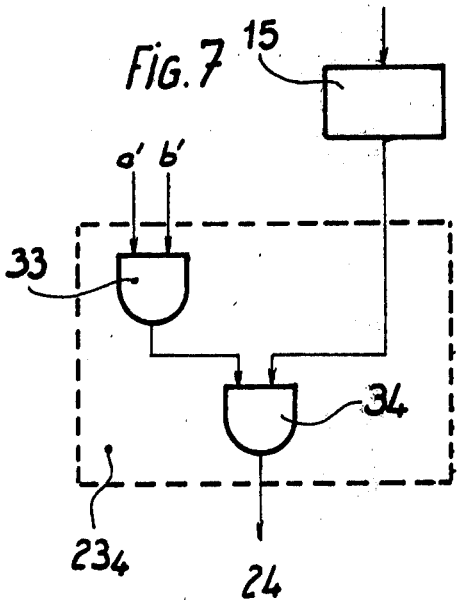

The logic unit $23_2$ (FIG. 5) takes into consideration the interval of time t2, t3. It comprises an OR gate 28 receiving at its two inputs signals a' and b' and an output signal sent to an input of an AND gate 29. The other input of this AND gate receives the signal a. All the times greater than the instant t2 are signified by a' = 1 or b' = 1 as can be seen in FIG. 2. In consequence the OR gate 28 detects the fact that the time is greater than the instant t2 and transmits a level 1 signal to the gate 29 when one or the other of the signals from inlets a' and b' is at level 1. In the interval of time t2, t3, the level from which the release of the binding should have taken place is F2 defined by the binary value 0,1111111. If the force is greater than that of level F2, the bit a of the binary combination corresponding to this force has the value 1. In consequence, in the interval t2, t3, if the force is greater than level F2, the bit a has the value 1 and as a result the gate 29 is open and transmits a signal releasing the binding.

The logic unit $23_3$ takes into consideration the interval of time t3 and t4. It comprises an OR gate 31 receiving at its two inputs the bits a and b and transmits its output signal to an input of an AND gate 32. This AND gate receives, at its other input, the bit a'.

It can be seen in FIG. 2 that at the end of the instant t3 the bit a' has still the value 1. Moreover, in this interval the level F3 corresponds to the binary value 0,0,1,1,1,1,1,1.

If the force is greater than level F3, this is indicated by the fact that the bit a or the bit b or these two bits simultaneously have the value 1. In consequence if, in the interval t3, t4 the force is greater than level F3, the OR gate 31 transmits an output level 1 signal; the AND gate 32 is then open and release of the binding is effected.

The logic unit $23_4$ takes into consideration the interval of time t4, t5 in which the force must not exceed the level F4 corresponding to the reference threshold. The logic unit $23_4$ comprises an AND gate 33 receiving at its two inputs the bits a' amnd b'. The output of this AND gate is connected to an input of another AND gate 34 of which the other input receives the output signal from the reference circuit 15.

It can be seen in FIG. 2 that at the end of the instant t4 the bits a' and b' both have the value 1, so that the gate 33 transmits an output level 1 signal to an input of the gate 34. If the force is greater than level F4, that is to say than the value detected by the reference circuit 15, this latter outputs a level 1 signal. The gate 34 is thus open and transmits an order for release of the binding.

It has been seen previously that the reference circuit 15 caused the starting of stages 21, 22 of the counter 19 as soon as the value of the force exceeded the lower threshold F4. In the same way, when the value of this force diminishes and becomes again lower than threshold F4, the reference circuit 15 indicates the return to their original state of stages 21 and 22 of the counter 19, so that they are ready for a new time counting operation when the force again exceeds the threshold F4.

In the example described above, the stepped threshold only comprises four levels defined by the four logic units $23_1$ to $23_4$. It is clear, however, that in practice this number can be considerably increased up to a maximum of $2^8$, that is to say, 256 levels since there can be provided at the output of the transformer 14 times 8 bits in parallel. The greater the number of threshold levels, the more it is possible to match the stepped threshold with the theoretical curve $F_{max}$ with regard to the maximum force bearable by the leg of the skier in terms of time. It will also be understood that by a judicious choice of the logic units, it would be possible to obtain any configuration of levels. It has been seen previously that the electrical control circuit preferably comprises a non-linear amplifier 11 to amplify differently the signal S corresponding to the force, according to whether this signal is weak or strong. In effect, if this non-linear amplifier were not provided, all the steps at the outlet of the analog/digital converter 14 would have the same value. For example, if one must detect a maximum force of 500 daN, one does so by using a circuit 14 with 8 bits of $2^8$, that is to say 256 steps or intervals. In this case each step would represent thus 500 daN divided by 256 or about 1.3 daN. For forces of greater values, this step of 1.3 daN would be sufficiently precise. However, for lesser forces, comprised notably between 10 and 20 daN, such a step would be too significant. For this reason the gain of the amplifier is to decrease as a function of the amplitude of the signals applied to its input so that signals of weak amplitudes, corresponding to weak forces, are advantageously amplified compared with the signals of greater amplitude corresponding to higher forces. Thus, the first steps at the output of the transformer have a weaker value than these latter. To express it in another way, a force of 20 daN for example, would be expressed by a signal composed of 256 steps each having the value of 1.3 daN.

In safety bindings it is necessary to provide for an adjustment of same, which takes into account the strength of the skier and his experience. To ensure this adjustment one can provide various methods. One of these consists, as has been seen previously, in modifying the gain of the amplifier 8 which is tantamount to causing the amplitude of signal S to vary for a similar value of force. If one increases the gain of the amplifier 8, one increases the amplitude of the signal S and consequently initiates release of the binding for a relatively lower value of the force. Inversely, if one reduces the gain, one "stiffens" the binding which does not release except for clearly higher forces.

In a modification, adjustment of the binding may be effected without varying the amplifier gain. In effect, it can be seen with reference to FIG. 2, that it is possible to shift the stepped threshold by acting on the output signal of the analog/digital converter 14 or on the output signal of the time counting unit 17. One may then envisage adding to the control circuit, means for modifying one or the other of the parameters, time and force, or even both parameters at the same time. For example, if the values of the levels F1, F2, F3, F4 are maintained, they can be made to correspond to the different intervals of time, that is to say, to make the level F2 correspond with the interval of time t1, t2 in the case where one wishes to lower the stepped threshold, or on the contrary, with the interval of time t3, t4 in the case where it is required to raise the threshold.

In the same way, one might, without changing the intervals of time, modify the levels which are associated with them.

This modification of the programming can be accomplished in various ways, either by providing for several cable circuits put into operation selectively by switches or by a changing, pure and simple, of all the treatment circuits in terms of the experience of the skier.

One could provide the electrical control circuit of the binding as a removable part made in the form of an integrated circuit, for example comprising the components 14, 15, 16 and 17. In the preceding description, it goes without saying that the detection circuit for the forces can detect either forces in terms of time, or displacements in terms of time, or accelerations or speeds.

What is claimed is:

1. A safety binding for a ski comprising a device for holding a ski boot on a ski, means for locking the holding device in position, means for releasing the locking means to free the holding device, and an electrical control circuit for actuating the releasing means and comprising means for detecting a force exerted on the leg of a skier and for producing a signal as a function of said force, and means for treating the signal to control operation of the releasing means dependent upon the intensity and duration of the force, said signal treating means including means for comparing the signal with successively different threshold values corresponding to different durations of application of force and means for effecting operation of the releasing means if the signal exceeds, in a time interval corresponding with a predetermined threshold level, the magnitude of the latter threshold level.

2. A safety binding according to claim 1 in which the different threshold levels diminish in magnitude with respect to time.

3. A safety binding according to claim 1 in which the signal treating means comprises an analog/digital converter to which is applied the signal representing the force exerted on the leg of the skier and which transmits a binary signal corresponding to the magnitude of the force, a time counting unit transmitting a binary signal corresponding to the time which has passed at the end of a reference time interval, and a logic unit to which is applied both binary signals, said logic unit defining the successive threshold levels in terms of time and emitting a signal for release of the binding if the value of the force is higher, in a determined interval of time, than the threshold level corresponding to this interval of time.

4. A safety binding according to claim 3 comprising a reference circuit connected to the output of the analog/digital converter and to the counting unit, in order to start the counting unit when the binary signal relative to the amplitude of the force becomes greater than a predetermined reference amplitude threshold and to restore to its original state the counting unit when the binary signal falls again below this reference amplitude threshold.

5. A safety binding according to claim 4 in which the counting unit comprises a frequency generator or clock connected to a counter comprising at least one counting stage, said counter being connected to the logic unit.

6. A safety binding according to claim 3 in which the logic unit comprises several logic units, each associated with a different threshold level, and each comprising a principal group of inputs connected to a predetermined combination of outputs from the analog/digital converter to detect at the output of the latter a binary signal which is a function of the amplitude of the force, and a second group of inputs connected to the counting unit to receive from the counting unit signals characterizing a predetermined interval of time starting from a reference, all the logic units being connected to an OR circuit connected to the releasing means of the binding.

7. A safety binding according to claim 1 wherein said electrical control circuit includes an amplifier with adjustable gain having an input receiving the signal which is a function of the force applied to the leg of the skier.

8. A safety binding according to claim 1, comprising means for modifying the correlation between the various threshold levels and the intervals of time associated with these levels, to shift in one direction or the other, the stopped threshold curve constituted by the different threshold levels.

* * * * *